US012584664B2

(12) United States Patent
Mercer

(10) Patent No.: US 12,584,664 B2
(45) Date of Patent: Mar. 24, 2026

(54) INTEGRATED REFRIGERANT CHARGE COLLECTOR FOR HEAT PUMPS

(71) Applicant: Rheem Manufacturing Company, Atlanta, GA (US)

(72) Inventor: Kevin Mercer, Atlanta, GA (US)

(73) Assignee: Rheem Manufacturing Company, Atlanta, GA (US)

( * ) Notice: Subject to any disclaimer, the term of this patent is extended or adjusted under 35 U.S.C. 154(b) by 254 days.

(21) Appl. No.: 18/350,585

(22) Filed: Jul. 11, 2023

(65) Prior Publication Data

US 2024/0019182 A1 Jan. 18, 2024

Related U.S. Application Data

(60) Provisional application No. 63/389,552, filed on Jul. 15, 2022.

(51) Int. Cl.
*F25B 43/00* (2006.01)
*F25B 13/00* (2006.01)

(52) U.S. Cl.
CPC ..... *F25B 43/006* (2013.01); *F25B 13/00* (2013.01)

(58) Field of Classification Search
CPC ..... F25B 43/006; F25B 13/00; F25B 2400/16
See application file for complete search history.

(56) References Cited

U.S. PATENT DOCUMENTS 4,030,315 A * 6/1977 Harnish ..... F25B 40/00 62/472
5,245,833 A * 9/1993 Mei ..... F25B 43/006 62/503
5,551,255 A * 9/1996 Rothfleisch ..... B01D 3/00 62/502
2015/0267949 A1* 9/2015 Koppineedi ..... F25B 41/20 62/503

FOREIGN PATENT DOCUMENTS

JP 5050857 B2 * 10/2012 ..... F25B 39/04

OTHER PUBLICATIONS

English translation of Yamazaki et al. (JP 5050857 B2). (Year: 2012).*

* cited by examiner

*Primary Examiner* — Miguel A Diaz
(74) *Attorney, Agent, or Firm* — Eversheds Sutherland (US) LLP

(57) ABSTRACT

An integrated refrigerant charge collector for a heat pump system is provided. The charge collector includes an elongated housing, and a divider plate disposed within the elongated housing to define an accumulator compartment and a receiver compartment. A horizontal plane of the divider plate is perpendicular to a longitudinal axis of the elongated housing. The accumulator compartment is in fluid communication with a reversing valve and a compressor of the heat pump system, and allows a desired flow of a refrigerant charge into the compressor during a heating mode and a cooling mode. The receiver compartment is in (Continued)

fluid communication with an indoor coil and an outdoor coil of the heat pump system, and extracts a liquid refrigerant from a circuit of the heat pump system during the heating mode, and adds the liquid refrigerant to the circuit during the cooling mode.

20 Claims, 3 Drawing Sheets

INTEGRATED REFRIGERANT CHARGE COLLECTOR FOR HEAT PUMPS

CROSS-REFERENCE TO RELATED APPLICATION

This application claims the benefit of U.S. Provisional Application No. 63/389,552, filed Jul. 15, 2022, the entirety of which is hereby incorporated by reference.

TECHNICAL FIELD

The present disclosure relates, in general, to heat pumps and, more specifically, relates to an integrated refrigerant charge collector for heat pump systems.

BACKGROUND

Generally, air conditioning systems are used for conditioning air within a closed space, and such air conditioning systems are designed and developed to heat or cool the air within the closed space more efficiently. In an example, an air conditioning system may be a heat pump for heating or cooling the closed space. As heat pumps are widely used nowadays, matching system volume ratio is critical to improve operational efficiency in both heating and cooling modes. Typically, heat exchangers define the majority of volume in the system and to make the operational performance of the heat exchangers more efficient, smaller diameter tubes and louvered fins are designed and developed to improve boiling and condensing performance.

However, such smaller diameter tubes and louvered fins make design of the system volume ratio complex and cumbersome. Utilizing smaller diameter tubes for better heat exchanger efficiency reduces an amount of liquid refrigerant that a heat exchanger can actually hold, and therefore causes higher system pressure in the opposite mode of operation. In an example, if the system is charged optimally for cooling mode with a heat exchanger having tubes with larger diameter, then the system will be severely overcharged in heating mode. Therefore, there is a need remains to develop a heat pump system that is cost effective and can operate more efficiently in both the heating and cooling modes.

SUMMARY

According to one aspect of the present disclosure, an integrated refrigerant charge collector for a heat pump system is disclosed. The integrated refrigerant charge collector includes an elongated housing defining a longitudinal axis, and a divider plate disposed within the elongated housing. The divider plate is configured to define an accumulator compartment and a receiver compartment within the elongated housing. A horizontal plane of the divider plate is perpendicular to the longitudinal axis of the elongated housing. The accumulator compartment is in fluid communication with a reversing valve and a compressor of the heat pump system. The accumulator compartment is configured to allow a desired flow of a refrigerant charge into the compressor during a heating mode and a cooling mode of the heat pump system. The receiver compartment is in fluid communication with an indoor coil and an outdoor coil of the heat pump system. The receiver compartment is configured to (i) extract a liquid refrigerant from a circuit of the heat pump system during the heating mode, and (ii) add the liquid refrigerant to the circuit of the heat pump system during the cooling mode.

In some embodiments, the accumulator compartment includes an inlet configured to fluidly communicate with the outdoor coil, an outlet configured to fluidly communicate with the compressor, and a J-tube having a top end configured to couple with the outlet and a bottom end configured to receive a refrigerant charge therethrough.

In some embodiments, the accumulator compartment includes a top end plate at a top end of the elongated housing, and a first side wall extending from a periphery of the top end plate. The divider plate, the top end plate, and the first side wall together define an accumulator volume to receive the refrigerant charge therein.

In some embodiments, the inlet and the outlet are defined in the top end plate and spaced apart from each other.

In some embodiments, the receiver compartment comprises a first port configured to fluidly communicate with the indoor coil and a second port configured to fluidly communicate with the outdoor coil.

In some embodiments, the receiver compartment includes a bottom end plate at a bottom end of the elongated housing, and a second side wall extending from a periphery of the bottom end plate. The divider plate, the bottom end plate, and the second side wall together define a receiver volume to receive the liquid refrigerant therein.

In some embodiments, the first port and the second port are defined in the second side wall, and are proximate a top edge and a bottom edge of the receiver compartment, respectively.

In some embodiments, the divider plate includes a top surface defining the accumulator compartment and a bottom surface defining the receiver compartment.

In some embodiments, the divider plate includes one or more protrusions extending downward from the bottom surface thereof.

In some embodiments, the divider plate is made of a metal or a metal alloy.

In some embodiments, an outer diameter of the elongated housing is in a range of 4 to 6 inches.

In some embodiments, a length of the elongated housing is in a range of 8 to 18 inches.

In some embodiments, the divider plate is located at a distance of 30% to 35% of the length of the elongated housing from a bottom end thereof.

In another aspect of the present disclosure, a heat pump system is disclosed. The heat pump system includes an indoor coil configured to condition air in a closed space, an outdoor coil configured to exchange heat with ambient air, a compressor in fluid communication with the indoor coil and the outdoor coil, and a reversing valve in fluid communication with the indoor coil, the outdoor coil, and the compressor. The reversing valve is configured to switch operation of the heat pump system between a heating mode and a cooling mode. The heat pump system further includes an integrated refrigerant charge collector in fluid communication with the indoor coil, the outdoor coil, the compressor, and the reversing valve. The integrated refrigerant charge collector is configured to (i) extract a liquid refrigerant from a circuit of the heat pump system during the heating mode, (ii) add the liquid refrigerant to the circuit during the cooling mode, and (iii) allow desired flow of a refrigerant charge into the compressor during the heating mode and the cooling mode. The integrated refrigerant charge collector includes an elongated housing, and a divider plate disposed within the elongated housing. The divider plate is configured to define an accumulator compartment and a receiver compartment. The accumulator compartment is in fluid communication with the reversing valve and the compressor, and the receiver compartment is in fluid communication with the indoor coil and the outdoor coil.

In some embodiments, the accumulator compartment includes a top end plate at a top end of the elongated housing, and a first side wall extending vertically downward from a periphery of the top end plate. The divider plate, the top end plate, and the first side wall together define an accumulator volume to receive the refrigerant charge therein.

In some embodiments, the accumulator compartment includes an inlet defined in the top end plate and configured to fluidly communicate with the reversing valve, an outlet defined in the top end plate and configured to fluidly communicate with the compressor, and a J-tube having a top end configured to couple with the outlet and a bottom end configured to receive the refrigerant charge therethrough.

In some embodiments, the receiver compartment includes a bottom end plate at a bottom end of the elongated housing, and a second side wall extending vertically upward from a periphery of the bottom end plate. The divider plate, the bottom end plate, and the second side wall together define a receiver volume to receive the liquid refrigerant therein.

In some embodiments, the receiver compartment includes a first port defined in the second side wall and configured to fluidly communicate with the indoor coil, and a second port defined in the second side wall and configured to fluidly communicate with the outdoor coil.

In some embodiments, the divider plate includes a top surface defining the accumulator compartment, a bottom surface defining the receiver compartment, and one or more protrusions extending downward from the bottom surface of the divider plate.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
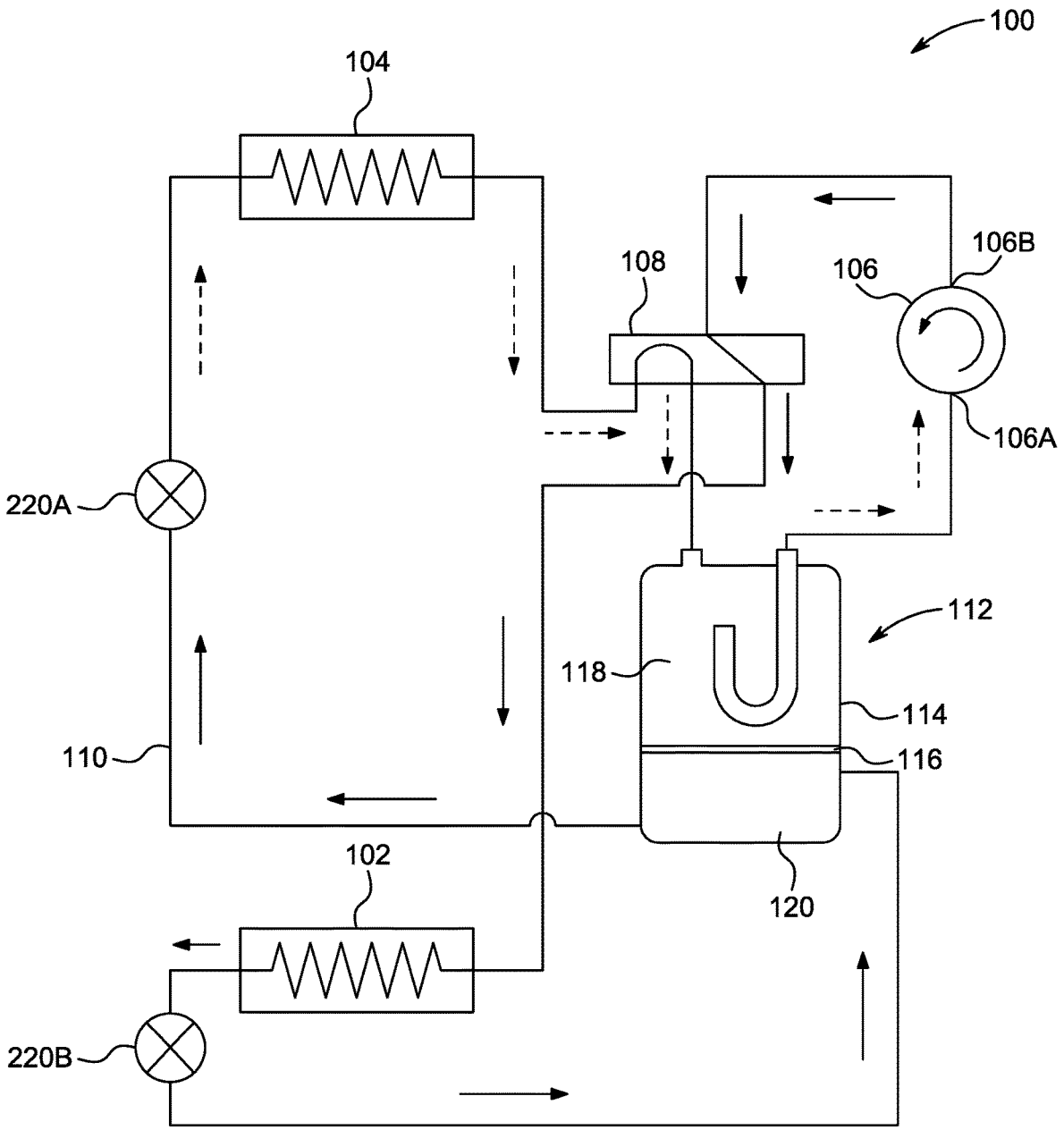
FIG. 1 is a schematic block diagram of a heat pump system, having an integrated refrigerant charge collector, operating in a heating mode, according to an embodiment of the present disclosure.

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. Accordingly, when the present disclosure is described as a particular example or in a particular context, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring to FIG. 1, a schematic block diagram of a heat pump system 100 is illustrated, according to an embodiment of the present disclosure. The heat pump system 100 includes an indoor coil 102 configured to condition air in a closed space. The closed space may be defined as a room which is closed to maintain a desired room temperature. The indoor coil 102 may be otherwise known as an indoor heat exchanger placed inside the closed space to extract heat from or add heat to air contained within the closed space using a refrigerant. The heat pump system 100 further includes an outdoor coil 104 configured to exchange heat with ambient air. The outdoor coil 104 may be otherwise known as an outdoor heat exchanger placed outside the closed space to extract heat from or release heat to the ambient air. The heat pump system 100 further includes a compressor 106 in fluid communication with the indoor coil 102 and the outdoor coil 104. The compressor 106 is fluidly coupled with the indoor coil 102 and the outdoor coil 104 using fluid conduits to allow flow of the refrigerant therethrough. The compressor 106 is configured to receive a low pressure refrigerant through an inlet port 106A and discharge a high pressure and high temperature refrigerant through an outlet port 106B.

The heat pump system 100 further includes a reversing valve 108 in fluid communication with the indoor coil 102, the outdoor coil 104, and the compressor 106. The reversing valve 108 is configured to switch operation of the heat pump system 100 between a heating mode and a cooling mode. As such, the indoor coil 102, the outdoor coil 104, the compressor 106, and the reversing valve 108 along with the fluid conduits together constitute a circuit 110 to form a closed loop system to cyclically operate the heat pump system 100. In the heating mode and the cooling mode of the heat pump system 100, the inlet port 106A of the compressor 106 is configured to fluidly communicate with the outdoor coil 104 and the indoor coil 102, respectively, and the outlet port 106B is configured to fluidly communicate with the reversing valve 108. As such, during the heating mode and the cooling mode, a high pressure high temperature refrigerant flows through the indoor coil 102 and the outdoor coil 104, respectively, through the outlet port 106B. The heating mode of the heat pump system 100 is shown in FIG. 1, and the reversing valve 108 is configured to be in a heating mode position during the heating mode. In the heating mode, the high pressure high temperature refrigerant flows through the indoor coil 102 to exchange heat energy with the air contained in the closed space.

The heat pump system 100 further includes an integrated refrigerant charge collector 112, hereinafter alternatively referred to as the "charge collector 112," in fluid communication with the indoor coil 102, the outdoor coil 104, the compressor 106, and the reversing valve 108. The charge collector 112 is configured to (i) extract a liquid refrigerant from the circuit 110 of the heat pump system 100 during the heating mode, (ii) add the liquid refrigerant to the circuit 110 during the cooling mode, and (iii) allow desired flow of the refrigerant charge into the compressor 106 during the heating mode and the cooling mode. The charge collector 112 includes an elongated housing 114 and a divider plate 116 disposed within the elongated housing 114. The divider plate 116 is configured to define an accumulator compartment 118 and a receiver compartment 120 within the elongated housing 114. The accumulator compartment 118 is in fluid communication with the reversing valve 108 and the compressor 106. Particularly, during the heating mode and the cooling mode, the accumulator compartment 118 is configured to fluidly communicate with the outdoor coil 104 and the indoor coil 102, respectively, though the reversing valve 108, and the receiver compartment 120 is in fluid communication with the indoor coil 102 and the outdoor coil 104.

Figure 2:
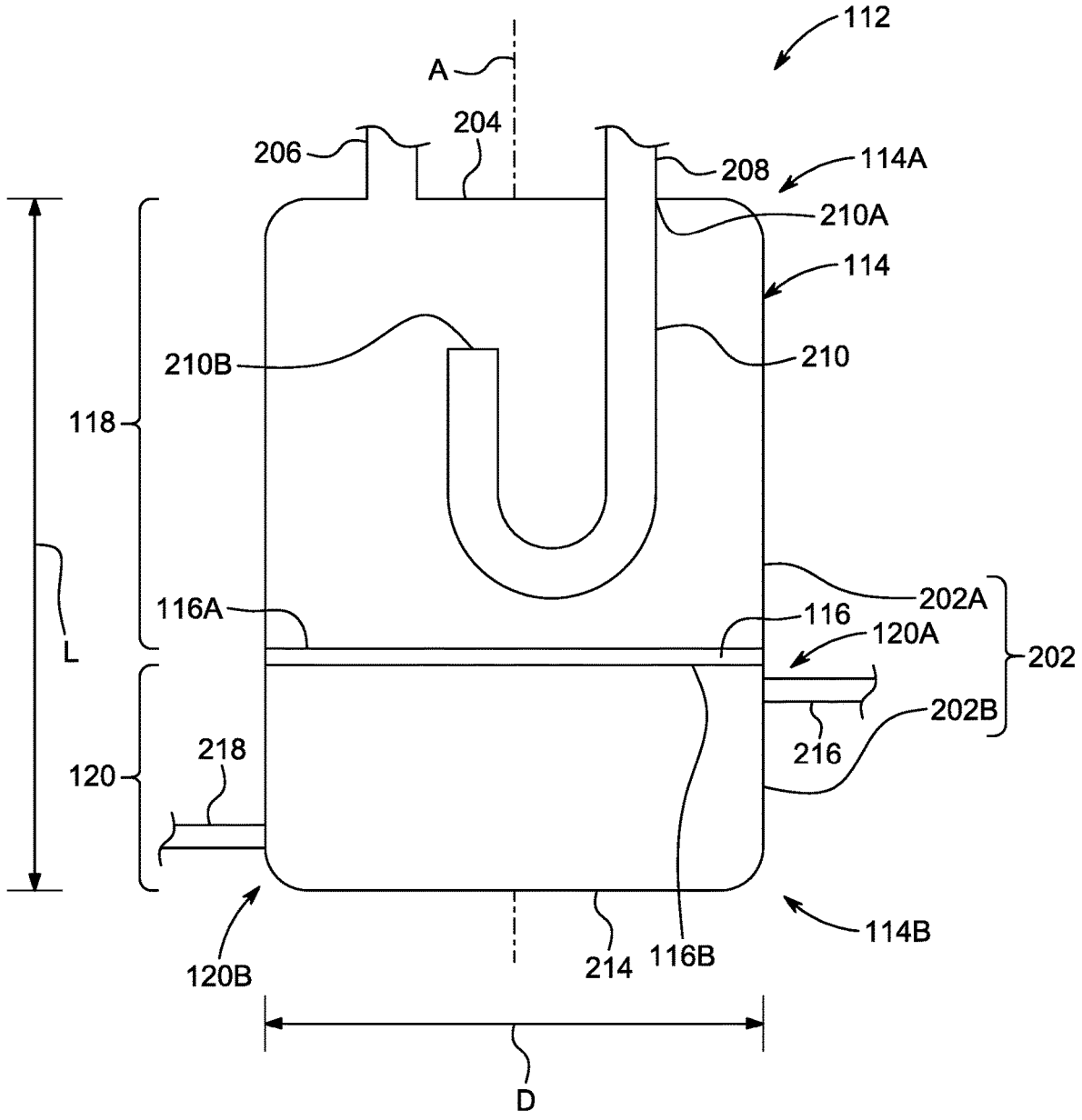
FIG. 2 is a schematic side view of the integrated refrigerant charge collector, according to an embodiment of the present disclosure.

Referring to FIG. 2, a schematic side view of the charge collector 112 is illustrated, according to an embodiment of the present disclosure. The charge collector 112 includes the elongated housing 114 defining a longitudinal axis 'A'. The elongated housing 114 has a top end 114A and a bottom end 114B defining a length 1' therebetween. In some embodiments, the length 'L' of the elongated housing 114 is in a range of 8 to 18 inches. The elongated housing 114 includes a wall 202 defining a cylindrical or other suitable shape having an outer diameter or dimension 'D'. In some embodiments, the outer diameter or dimension 'D' of the elongated housing 114 is in a range of 4 to 6 inches. The charge collector 112 further includes the divider plate 116 disposed within the elongated housing 114. The divider plate 116 is configured to define the accumulator compartment 118 and the receiver compartment 120 within the elongated housing 114. The divider plate 116 is disposed within the elongated housing 114 such that a horizontal plane of the divider plate 116 is perpendicular to the longitudinal axis 'A' of the elongated housing 114.

The accumulator compartment 118 includes a top end plate 204 disposed at the top end 114A of the elongated housing 114 and a first side wall 202A extending from a periphery of the top end plate 204. Particularly, the first side wall 202A extends vertically downward from the periphery of the top end plate 204. The first side wall 202A is otherwise referred to as a portion of the wall 202 of the elongated housing 114. Thus, the divider plate 116, the top end plate 204, and the first side wall 202A together define an accumulator volume to receive the refrigerant charge therein. The accumulator compartment 118 further includes an inlet 206 defined in the top end plate 204 and configured to fluidly communicate with the reversing valve 108. The accumulator compartment 118 further includes an outlet 208 defined in the top end plate 204 and configured to fluidly communicate with the compressor 106. The inlet 206 and the outlet 208 of the accumulator compartment 118 are defined in the top end plate 204 such that they are spaced apart from each other. The accumulator compartment 118 further includes a J-tube 210 having a top end 210A configured to couple with the outlet 208 and a bottom end 210B configured to receive the refrigerant charge therethrough.

The receiver compartment 120 includes a bottom end plate 214 disposed at the bottom end 114B of the elongated housing 114 and a second side wall 202B extending from a periphery of the bottom end plate 214. Particularly, the second side wall 202B extends vertically upward from the periphery of the bottom end plate 214. The second side wall 202B is otherwise referred to as a remaining portion of the wall 202 of the elongated housing 114. As such, the first side wall 202A and the second side wall 202B together constitute the wall 202 of the elongated housing 114. The divider plate 116, the bottom end plate 214, and the second side wall 202B together define a receiver volume to receive the liquid refrigerant therein. The receiver compartment 120 further includes a first port 216 configured to fluidly communicate with the indoor coil 102 and a second port 218 configured to fluidly communicate with the outdoor coil 104. In some embodiments, the first port 216 and the second port 218 are defined in the second side wall 202B, and are proximate a top edge 120A and a bottom edge 120B, respectively, of the receiver compartment 120. In certain embodiments, the top edge 120A and the bottom edge 120B of the receiver compartment 120 defines a length therebetween which is 30% to 35% of the length 'L' of the elongated housing 114. As such, the divider plate 116 may be located at a distance of 30% to 35% of the length 'L' of the elongated housing 114 from the bottom end 114B thereof.

The divider plate 116 includes a top surface 116A defining the accumulator compartment 118 and a bottom surface 116B defining the receiver compartment 120. In some embodiments, the divider plate 116 is made of a metal or a metal alloy. In some embodiments, the divider plate 116 includes one or more protrusions (not shown) extending downward from the bottom surface 116B thereof. Particularly, the one or more protrusions extend vertically downward from the bottom surface 116B of the divider plate 116 such that heat from vapor gas may conduct through the protrusions to make the divider plate 116 cold. That is, cold gas may conduct through the protrusions to make the divider plate cold. Beneficially, the divider plate being cold may encourage attraction of refrigerant to the surface thereof and the liquid may collect there. In some embodiments, the one or more protrusions may be individual components separately attached to the bottom surface 116B of the divider plate 116. In some embodiments, the one or more protrusions may be formed integral to the divider plate 116.

During the heating mode of the heat pump system 100, referring to FIG. 1 and FIG. 2, the reversing valve 108 is in the heating mode position such that the high pressure high temperature refrigerant (represented by solid arrow lines in FIG. 1) from the compressor 106 flows through the indoor coil 102 to exchange heat energy with the air contained in the closed space. The accumulator compartment 118 is in fluid communication with the outdoor coil 104 and the compressor 106 of the heat pump system 100. Particularly, the inlet 206 of the accumulator compartment 118 is fluidly coupled to the outdoor coil 104 though the reversing valve 108 and the outlet 208 is fluidly coupled to the compressor 106. The receiver compartment 120 is in fluid communication with the indoor coil 102 and the outdoor coil 104 of the heat pump system 100. Particularly, the indoor coil 102 is fluidly coupled to the first port 216 of the receiver compartment 120 to allow the high pressure high temperature refrigerant to flow therethrough. The second port 218 of the receiver compartment 120 is fluidly coupled to the outdoor coil 104 via a first expansion valve 220A such that the high pressure high temperature refrigerant flows from the indoor coil 102 to the first expansion valve 220A through the receiver compartment 120. The receiver compartment 120 is configured to extract the liquid refrigerant from the circuit 110 of the heat pump system 100 during the heating mode. At the first expansion valve 220A, the high pressure high temperature refrigerant expands to become low pressure low temperature refrigerant (represented by dotted arrow lines in FIG. 1) and flows through the outdoor coil 104 and to the accumulator compartment 118 of the charge collector 112 via the reversing valve 108. The accumulator compartment 118 is configured to allow the desired flow of the refrigerant charge into the compressor 106 during the heating mode of the heat pump system 100.

Figure 3:
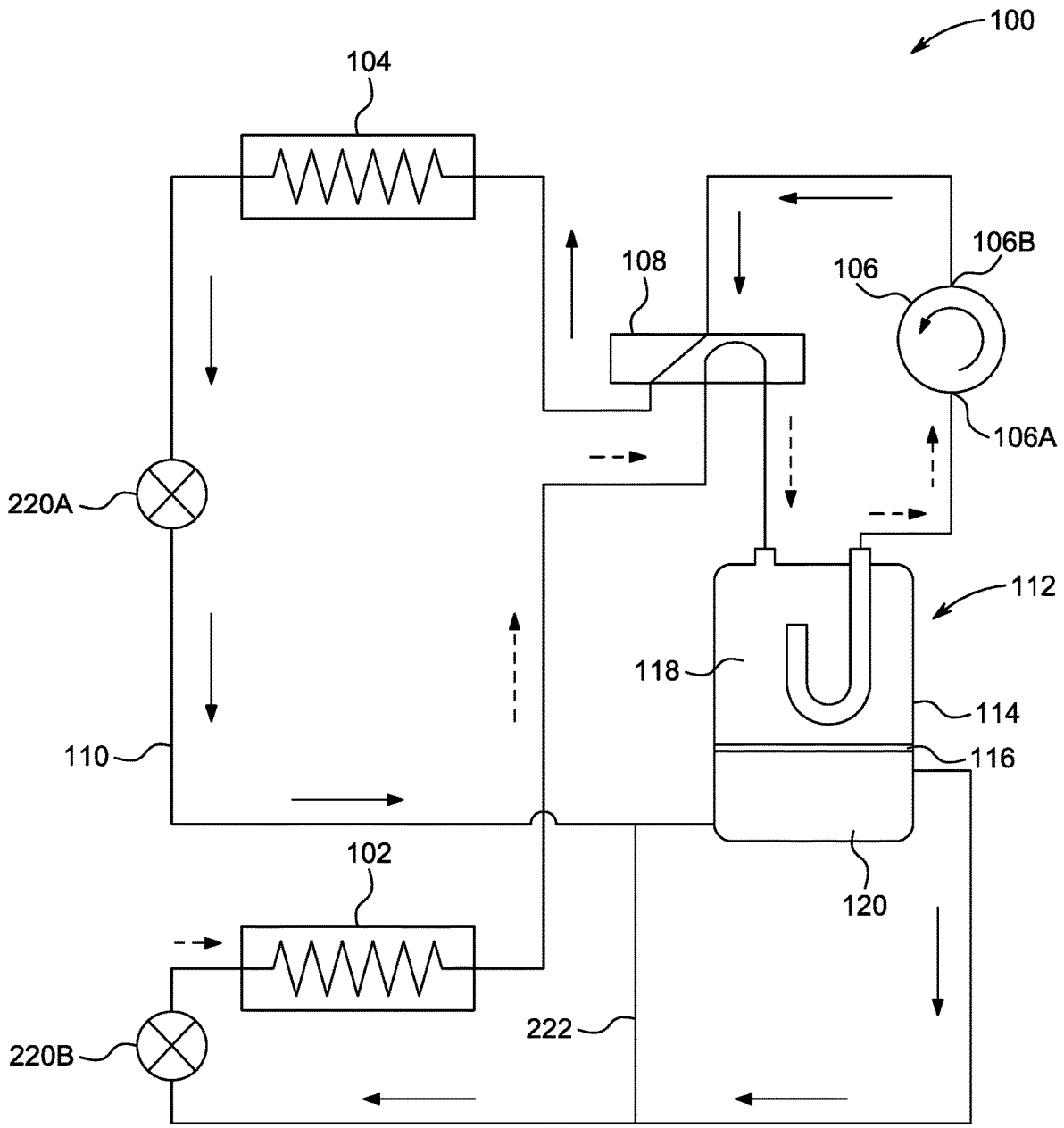
FIG. 3 is a schematic block diagram of the heat pump system operating in a cooling mode, according to an embodiment of the present disclosure.

During the cooling mode of the heat pump system 100, referring to FIG. 2 and FIG. 3, the reversing valve 108 is configured to be in a cooling mode position such that the high pressure high temperature refrigerant (represented by solid arrow lines) from the compressor 106 flows through the outdoor coil 104 via the reversing valve 108 to exchange heat energy with the ambient air. The accumulator compartment 118 of the charge collector 112 is in fluid communication with the indoor coil 102 and the compressor 106 of the heat pump system 100. Particularly, the inlet 206 of the accumulator compartment 118 is fluidly coupled to the indoor coil 102 via the reversing valve 108 and the outlet 208 is fluidly coupled to the compressor 106. The receiver compartment 120 is in fluid communication with the indoor coil 102 and the outdoor coil 104 of the heat pump system 100. Particularly, the outdoor coil 104 is fluidly coupled to the second port 218 of the receiver compartment 120 to allow flow of the high pressure high temperature refrigerant to flow therethrough. The first port 216 of the receiver compartment 120 is fluidly coupled to the indoor coil 102 via a second expansion valve 220B such that the high pressure high temperature refrigerant flows from the outdoor coil 104 to the second expansion valve 220B through the receiver compartment 120. The receiver compartment 120 is configured to add the liquid refrigerant to the circuit 110 of the heat pump system 100 during the cooling mode. At the second expansion valve 220B, the high pressure high temperature refrigerant expands to become low pressure low temperature refrigerant (represented by dotted arrow lines in FIG. 3) and flows through the indoor coil 102 and to the accumulator compartment 118 of the charge collector 112 via the reversing valve 108. The accumulator compartment 118 is configured to allow the desired flow of the refrigerant charge into the compressor 106 during the cooling mode of the heat pump system 100. In some embodiments, the high pressure high temperature refrigerant coming through the outdoor coil 104 may be bypassed from entering into the receiver compartment 120 using a bypass conduit 222 to communicate with the second expansion valve 220B. In such a case, a check valve may be disposed in the bypass conduit 222.

The present disclosure relates to the heat pump system 100 having the integrated refrigerant charge collector 112 to facilitate operation of the heat pump system 100 more efficiently during both the heating mode and the cooling mode. Typically, the indoor coil 102 is made smaller than the outdoor coil 104 in terms of volume by reducing diameter of tubes to operate the heat pump more efficiently. However, such design of the heat pump leads to a mismatch in the volume ratio. Therefore, the integrated refrigerant charge collector 112 further improves the operational efficiency of the heat pump system 100 during the heating and cooling modes. By making the accumulator compartment 118 and the receiver compartment 120 into a single unit, such as the integrated refrigerant charge collector 112, the design and development of the heat pump system 100 become more cost effective. Further, the receiver volume of the receiver compartment 120 can be increased based on the application of the heat pump system 100 as the receiver compartment 120 is defined at bottom of the accumulator compartment 118. Since the second port 218 of the receiver compartment 120 is defined proximate the bottom edge 120B thereof, the collected liquid refrigerant along with the oil may entirely flow through the second port 218.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. An integrated refrigerant charge collector for a heat pump system comprising:

an elongated housing defining a longitudinal axis, wherein a length of the elongated housing is in a range of 8 to 18 inches; and a divider plate disposed within the elongated housing, and configured to define an accumulator compartment and a receiver compartment within the elongated housing, wherein a horizontal plane of the divider plate is perpendicular to the longitudinal axis of the elongated housing, and wherein the divider plate is located at a distance of at least 30% of the length of the elongated housing from a bottom end thereof, wherein the accumulator compartment is in fluid communication with a reversing valve and a compressor of the heat pump system, and configured to allow a desired flow of a refrigerant charge into the compressor during a heating mode and a cooling mode of the heat pump system, and wherein the receiver compartment is in fluid communication with an indoor coil and an outdoor coil of the heat pump system, and configured to (i) extract a liquid refrigerant from a circuit of the heat pump system during the heating mode, and (ii) add the liquid refrigerant to the circuit of the heat pump system during the cooling mode.

2. The integrated refrigerant charge collector of claim 1, wherein the accumulator compartment comprises:

an inlet configured to fluidly communicate with the outdoor coil;

an outlet configured to fluidly communicate with the compressor; and a J-tube having a top end configured to couple with the outlet and a bottom end configured to receive a refrigerant charge therethrough.

3. The integrated refrigerant charge collector of claim 2, wherein the accumulator compartment comprises:

a top end plate at a top end of the elongated housing; and a first side wall extending from a periphery of the top end plate, wherein the divider plate, the top end plate, and the first side wall together define an accumulator volume to receive the refrigerant charge therein.

4. The integrated refrigerant charge collector of claim 3, wherein the inlet and the outlet are defined in the top end plate and spaced apart from each other.

5. The integrated refrigerant charge collector of claim 1, wherein the receiver compartment comprises a first port configured to fluidly communicate with the indoor coil and a second port configured to fluidly communicate with the outdoor coil.

6. The integrated refrigerant charge collector of claim 5, wherein the receiver compartment comprises:

a bottom end plate at a bottom end of the elongated housing; and a first side wall extending from a periphery of the bottom end plate, wherein the divider plate, the bottom end plate, and the first side wall together define a receiver volume to receive the liquid refrigerant therein.

7. The integrated refrigerant charge collector of claim 6, wherein the first port and the second port are defined in the second side wall, and are proximate a top edge and a bottom edge of the receiver compartment, respectively.

8. The integrated refrigerant charge collector of claim 1, wherein the divider plate comprises a top surface defining the accumulator compartment and a bottom surface defining the receiver compartment.

9. The integrated refrigerant charge collector of claim 1, wherein the divider plate is made of a metal or a metal alloy.

10. The integrated refrigerant charge collector of claim 1, wherein an outer diameter of the elongated housing is in a range of 4 to 6 inches.

11. A heat pump system comprising:

an indoor coil configured to condition air in a closed space;

an outdoor coil configured to exchange heat with ambient air;

a compressor in fluid communication with the indoor coil and the outdoor coil;

a reversing valve in fluid communication with the indoor coil, the outdoor coil, and the compressor, and configured to switch operation of the heat pump system between a heating mode and a cooling mode; and an integrated refrigerant charge collector in fluid communication with the indoor coil, the outdoor coil, the compressor, and the reversing valve, wherein the integrated refrigerant charge collector is configured to (i) extract a liquid refrigerant from a circuit of the heat pump system during the heating mode, (ii) add the liquid refrigerant to the circuit during the cooling mode, and (iii) allow desired flow of a refrigerant charge into the compressor during the heating mode and the cooling mode, wherein the integrated refrigerant charge collector comprises:

an elongated housing, wherein a length of the elongated housing is in a range of 8 to 18 inches; and a divider plate disposed within the elongated housing, and configured to define an accumulator compartment and a receiver compartment, wherein the accumulator compartment is in fluid communication with the reversing valve and the compressor, and the receiver compartment is in fluid communication with the indoor coil and the outdoor coil, and wherein the divider plate is located at a distance of at least 30% of the length of the elongated housing from a bottom end thereof.

12. The heat pump system of claim 11, wherein the accumulator compartment comprises:

a top end plate at a top end of the elongated housing; and a first side wall extending vertically downward from a periphery of the top end plate, wherein the divider plate, the top end plate, and the first side wall together define an accumulator volume to receive the refrigerant charge therein.

13. The heat pump system of claim 12, wherein the accumulator compartment comprises:

an inlet defined in the top end plate and configured to fluidly communicate with the reversing valve;

an outlet defined in the top end plate and configured to fluidly communicate with the compressor; and a J-tube having a top end configured to couple with the outlet and a bottom end configured to receive the refrigerant charge therethrough.

14. The heat pump system of claim 11, wherein the receiver compartment comprises:

a bottom end plate at a bottom end of the elongated housing; and a first side wall extending vertically upward from a periphery of the bottom end plate, wherein the divider plate, the bottom end plate, and the first side wall together define a receiver volume to receive the liquid refrigerant therein.

15. The heat pump system of claim 14, wherein the receiver compartment comprises:

a first port defined in the second side wall and configured to fluidly communicate with the indoor coil; and a second port defined in the second side wall and configured to fluidly communicate with the outdoor coil.

16. The heat pump system of claim 11, wherein the divider plate comprises:

a top surface defining the accumulator compartment; and a bottom surface defining the receiver compartment.

17. An integrated refrigerant charge collector for a heat pump system comprising:

an elongated housing defining a longitudinal axis, wherein a length of the elongated housing is in a range of 8 to 18 inches; and a divider plate disposed within the elongated housing, and configured to define an accumulator compartment and a receiver compartment within the elongated housing, wherein a horizontal plane of the divider plate is perpendicular to the longitudinal axis of the elongated housing, and wherein the divider plate is located at a distance of at least 30% of the length of the elongated housing from a bottom end thereof, wherein the accumulator compartment is in fluid communication with a reversing valve and a compressor of the heat pump system, and wherein the receiver compartment is in fluid communication with an indoor coil and an outdoor coil of the heat pump system, and configured to (i) extract a liquid refrigerant from a circuit of the heat pump system during a heating mode, and (ii) add the liquid refrigerant to the circuit of the heat pump system during a cooling mode.

18. The integrated refrigerant charge collector of claim 17, wherein the accumulator compartment comprises:

an inlet configured to fluidly communicate with the outdoor coil;

an outlet configured to fluidly communicate with the compressor; and a J-tube having a top end configured to couple with the outlet and a bottom end configured to receive a refrigerant charge therethrough.

19. The integrated refrigerant charge collector of claim 18, wherein the accumulator compartment comprises:

a top end plate at a top end of the elongated housing; and a first side wall extending from a periphery of the top end plate, wherein the divider plate, the top end plate, and the first side wall together define an accumulator volume to receive the refrigerant charge therein.

20. The integrated refrigerant charge collector of claim 17, wherein the divider plate is located at a distance of between 30% and 35% of the length of the elongated housing.

* * * * *